US009867472B2

(12) United States Patent
Glöckl et al.

(10) Patent No.: US 9,867,472 B2
(45) Date of Patent: Jan. 16, 2018

(54) ACTIVE DYNAMIC CHAIR

(71) Applicant: aeris GmbH, Haar bei München (DE)

(72) Inventors: Josef Glöckl, Kirchheim (DE); Thomas Hermann Schröder, Beaumont, TX (US)

(73) Assignee: aeris GmbH, Haar bei München (DE)

( * ) Notice: Subject to any disclaimer, the term of this patent is extended or adjusted under 35 U.S.C. 154(b) by 239 days.

(21) Appl. No.: 14/405,619

(22) PCT Filed: Jun. 10, 2013

(86) PCT No.: PCT/EP2013/061888
§ 371 (c)(1),
(2) Date: Dec. 4, 2014

(87) PCT Pub. No.: WO2013/186157
PCT Pub. Date: Dec. 19, 2013

(65) Prior Publication Data

US 2015/0130239 A1 May 14, 2015

Related U.S. Application Data

(60) Provisional application No. 61/658,121, filed on Jun. 11, 2012.

(30) Foreign Application Priority Data

Oct. 19, 2012 (DE) ..... 10 2012 110 032

(51) Int. Cl.
*A47C 9/00* (2006.01)
*A47C 3/22* (2006.01)
*A47C 3/025* (2006.01)

(52) U.S. Cl.
CPC ..... *A47C 9/002* (2013.01); *A47C 3/025* (2013.01); *A47C 3/22* (2013.01)

(58) Field of Classification Search
USPC ..... 297/314, 311
See application file for complete search history.

(56) References Cited

U.S. PATENT DOCUMENTS 908,999 A * 1/1909 Johnson ..... A47C 3/18 108/159
1,016,763 A * 2/1912 Nill ..... A47C 3/18 248/188.91

(Continued)

FOREIGN PATENT DOCUMENTS

DE 4244657 A1 10/1993
DE 202004000221 U1 4/2004
EP 0808116 A1 11/1997

OTHER PUBLICATIONS

International Search Report (in German with English Translation) for PCT/EP2013/061888, dated Jul. 31, 2013; ISA/EP.

(Continued)

*Primary Examiner* — David E Allred
(74) *Attorney, Agent, or Firm* — Harness, Dickey & Pierce, P.L.C.

(57) ABSTRACT

The invention relates to an active dynamic stool comprising the following: a seat part, a three-dimensional articulation system made up of at least three legs with foot parts at the lower end thereof, wherein the legs each have their upper end mounted on the seat part for movement on seat-part-mounted connecting articulations, such that the seat part can execute oscillating and circular movements in respect of its non-deflected rest position.

10 Claims, 13 Drawing Sheets

(56) References Cited

U.S. PATENT DOCUMENTS 1,075,964 A * 10/1913 Colling, Sr. ..... A47C 3/18 297/311
1,398,935 A * 11/1921 Miller ..... A47C 3/0252 248/576
2,132,291 A * 10/1938 Fitos ..... A47C 3/025 248/415
2,707,986 A * 5/1955 Johnson ..... B60N 2/39 248/567
3,784,148 A * 1/1974 Hill ..... A47C 3/025 248/582
4,095,770 A * 6/1978 Long ..... B60N 2/39 248/371
4,372,606 A * 2/1983 Faull ..... A47C 3/025 297/265.1
4,830,345 A * 5/1989 Mar ..... A47C 7/14 248/624
4,932,719 A * 6/1990 Gonzalez y. Rojas A47C 7/022 248/171
5,044,587 A * 9/1991 Degen ..... A47C 3/025 108/150
5,179,525 A * 1/1993 Griffis ..... B23Q 1/5462 434/55
5,348,370 A * 9/1994 Fukuoka ..... B60N 2/24 297/217.3
5,451,093 A * 9/1995 Petrie ..... A47D 13/107 248/618
5,524,967 A 6/1996 Glockl
5,720,524 A * 2/1998 Hall ..... A47C 3/18 108/65
5,746,481 A * 5/1998 Obermaier ..... A47C 3/0255 248/599
5,769,492 A * 6/1998 Jensen ..... A47C 9/002 297/188.09
5,909,925 A 6/1999 Glockl
5,921,628 A 7/1999 Glockl
5,921,926 A 7/1999 Rolland et al.
6,056,362 A * 5/2000 de la Haye ..... A47C 3/02 248/394
6,106,064 A * 8/2000 Hibberd ..... A47C 3/025 297/313
6,572,061 B2 * 6/2003 Overbeck ..... A47C 4/20 248/163.1
7,802,764 B2 * 9/2010 Leinen ..... A61M 5/1415 248/129
8,540,314 B2 * 9/2013 Fernandez ..... A47C 3/30 297/314
8,607,809 B2 * 12/2013 Jordan ..... A45B 3/04 135/66
2002/0015624 A1 * 2/2002 Wang ..... B23Q 1/5462 409/201
2004/0052628 A1 * 3/2004 Thurneysen ..... B23Q 1/4852 414/699
2008/0271241 A1 * 11/2008 Tholkes ..... A61G 5/0833 5/11
2011/0126660 A1 * 6/2011 Lauzier ..... B25J 17/0208 74/490.05
2011/0198905 A1 * 8/2011 Welch ..... A47D 3/00 297/311
2012/0139310 A1 * 6/2012 Aldred ..... A47C 3/18 297/311
2015/0114165 A1 * 4/2015 Lauzier ..... B25J 17/0208 74/490.05

OTHER PUBLICATIONS

International Preliminary Report for PCT/EP2013/061888 dated Dec. 24, 2014.

* cited by examiner

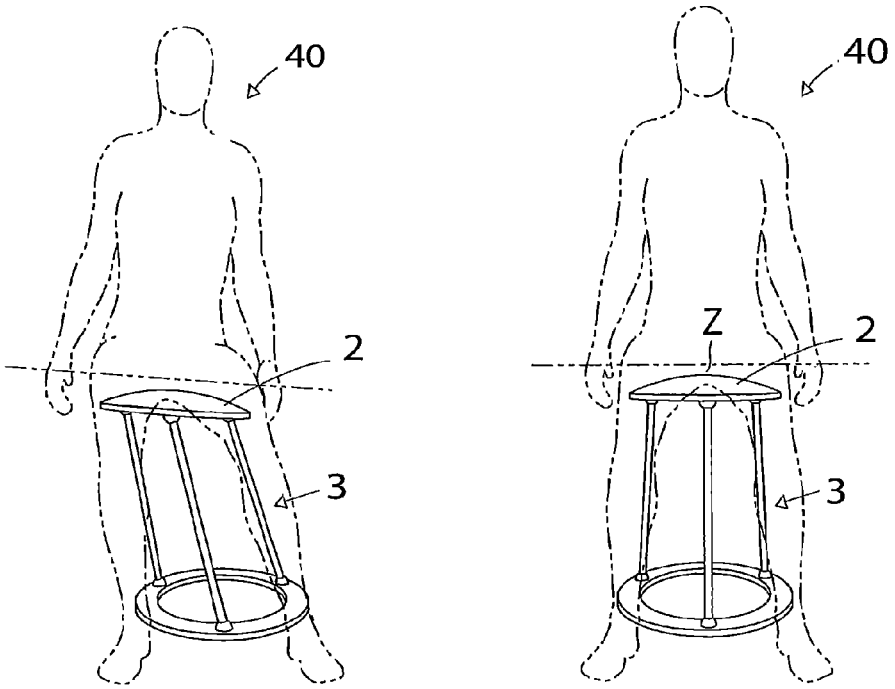
Fig. 3
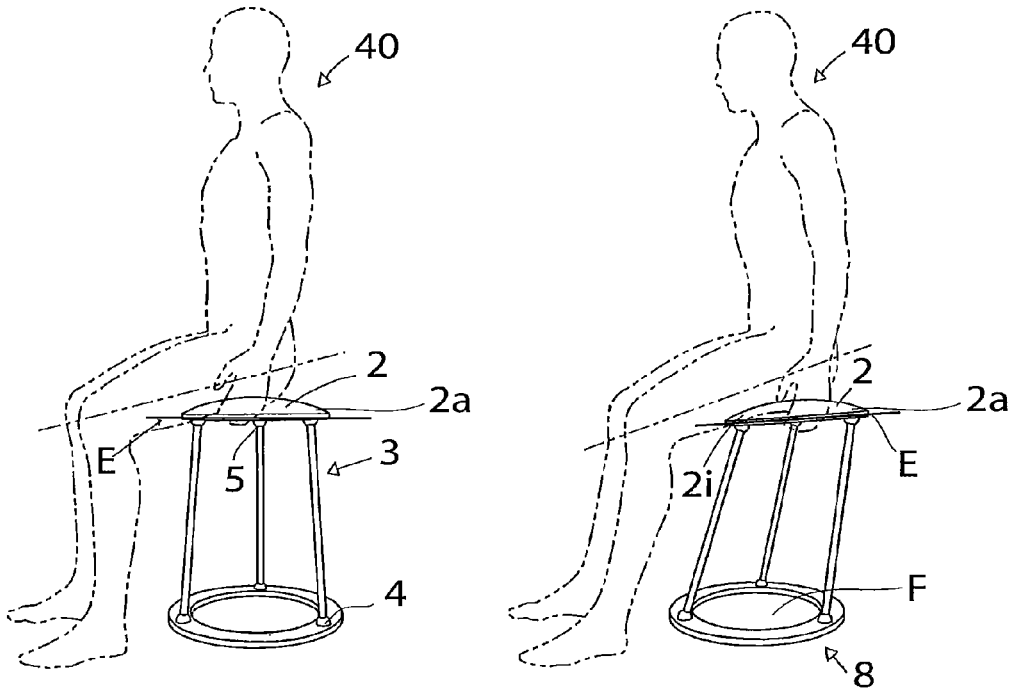

ACTIVE DYNAMIC CHAIR

CROSS REFERENCE TO RELATED APPLICATIONS

This application is a U.S. National Phase Application under 35 U.S.C. 371 of International Application No. PCT/EP2013/061888 filed on Jun. 10, 2013 and published in German as WO 2013/186157 A1 on Dec. 19, 2013. This application is based on and claims the benefit of priority from German Patent Application No. 10 2012 110 032.2 filed Oct. 19, 2012 and U.S. Provisional Application No. 61/658,121 filed Jun. 11, 2012. The entire disclosures of all of the above applications are incorporated herein by reference.

The present invention relates to an active-dynamic chair in accordance with claim 1. The invention relates in particular to an active-dynamic seat device with a seat part for rocking and moving from a home position into a deflected position, it also being possible to perform forms of movement consisting of a combination and/or superposition of elliptical movements and rocking movements. Upon rocking and moving the seat out of its home position, the relative change in inclination of the seat part is influenced by the specific configuration of a three-dimensional linkage system.

Moving or active-dynamic chairs differ from static chairs in that the chair user who is sitting on the chair can while so doing perform movements of the trunk and the body together with the seat part, which is not possible with static chairs.

Human physiology prefers dynamic movements to static resting even when sitting. Chairs which bear the weight of the legs at the same time should not only permit dynamic movement, but also offer the seat user ergonomic support.

Seating furniture in most cases is equipped with correspondingly shaped seat surfaces and rests in a position which is anatomically as beneficial as possible, so that the body, in particular the back, is supported. Such seating furniture is frequently perceived as comfortable, but has the crucial disadvantage that the body sits merely passively, i.e. the back muscles are scarcely engaged and the intervertebral discs are subject to permanent compression. If these seat devices are used for a relatively long time, this may result in degeneration of the back muscles and wear on the intervertebral discs. Damage to the health and pain in the back and hip regions are frequent consequences of static or passive sitting.

For this reason, active-dynamic seat devices have been developed which allow what is called active dynamic sitting, in which the back muscles and the intervertebral discs are always slightly active. This active-dynamic sitting posture is achieved in practically all cases in that the actual seat of the seat device is held in an unstable position and can be rocked to and fro from a home position into a laterally deflected position by the seat user.

An active-dynamic pendulum chair of this type is known for example from DE 42 44 657 02. Therein, a generic seat device is described which consists of a foot part, an intermediate piece connected to the foot part, and a seat part which is rigidly connected to the intermediate piece, the intermediate piece being held in an opening in the foot part so as to be tiltable in every lateral direction by means of an elastically deformable connecting element, and in the unloaded state being returned into its neutral position (home position).

EP 0 808 116 B1 describes a self-aligning bearing which is arranged between the column and the foot part. The self-aligning bearing is formed as a rubber-metal swing connector and consists of a substantially tubular upper part, the upper end of which serves as a spline connection, a lower part which is fastened fixedly to an arm of the foot part, and a resilient material arranged between the upper part and the lower part. The self-aligning bearing allows the seat part to rock to and fro.

For example, U.S. Pat. No. 5,921,926 discloses an active-dynamic pendulum chair which is likewise based on the principle of an inverted pendulum. Such chairs have a defined path of movement and a structural restoring mechanism which at the same time have a protective device in order to prevent the chair from tipping over. However, the seat upon a rocking movement tilts backwards from the horizontal position into an inclined position pointing away from the centre of the body.

Such pendulum chairs make it possible for the seat to rock to and fro from the non-deflected starting position into various deflected positions, as a result of which the seat surface tilts from its horizontal position into an inclined position. The tilt angle in such case depends on the direction of the deflection and the degree of the deflection. For example, the seat in the case of a pendulum chair in which the horizontally attached seat is connected fixedly to a pendulum column which is movable to and fro inclines with increasing deflection of the column from its horizontal position into a distinct inclined position.

With the pendulum chairs known from the prior art, the degree of inclination of the seat follows exclusively dependent on the angle of deflection upon the rocking movement. In the home position, the seat as a rule does not exhibit any inclination; rather, the (idealised) seat surface is oriented parallel to the base surface. If the seat is now deflected out of its home position into any inclined position whatsoever, the seat surface inclines accordingly, since the seat is connected rigidly to the pendulum support. The greater the angle of the rocking movement, the greater the inclination of the seat surface. In such case, the seat inclines upon rocking to and fro from its home position into its deflected position, so that that region of the seat which in each case is located further to the outside relative to the home position upon rocking is lowered relative to the region located further to the inside. Thus the seat user, for example in the case of rocking movements backwards, ends up in a supine position, which is not pleasant for every seat user. In the event of excessive rocking movements, it might also happen that the seat user loses his balance. Depending on the different requirements of chair users, there is accordingly a need for pendulum chairs with a different, preferably settable, change in inclination. In particular, there are seat users who prefer a precisely opposite change in inclination when rocking outwards.

With the pendulum chairs known from the prior art, further merely rocking movements about a self-aligning bearing which is close to the ground can be performed.

Upon dynamic movements of a seated person, it is however desirable for him further to move his entire body including his trunk, similarly to a movement with a "hula hoop", and in so doing to be able to perform both rocking movements "as such" and "lateral" deflections (i.e. horizontal translational movements) with the pelvis, in order to compensate for the transfers of weight of the upper regions such as arms and head and set them moving.

Departing from the prior art, it is therefore an object of the present invention to overcome the aforesaid disadvantages and to provide an active-dynamic chair with which the seat user can perform many different, safe movements of the seat part in the entire movement space. Advantageously, in so doing horizontal translational movements of the seat region by the chair user should also be made possible, and the change in the seat inclination should take place according to the ergonomic requirements of the seat user.

Further co-ordinate objects are:

a) Controllable horizontal rocking, translational and/or rotational movements of the pelvis of a seat user should be possible, upon which the seat is guided into a defined inclined position during the movements;

b) The chair should ensure an ergonomic sequence of movement;

c) The chair should have a restoring mechanism or a spring mechanism for returning to its initial position (home position);

d) The seat inclination in the home position should be able to be adapted individually.

This object is achieved by the measures described in the co-ordinate independent claims. Advantageous configurations of the invention are described in the respective dependent claims.

Further, the complete contents of the German patent application having the number DE 10 2013 102 034.8 are jointly incorporated by reference in the present application.

The basic concept of the present invention lies in the suitable attachment and arrangement of a three-dimensional (yielding) linkage system, preferably formed from three-dimensional four-bar linkage corners.

Therein, a three-dimensional linkage system consisting of at least three legs with foot parts at their lower ends is provided, wherein the legs in each case at their upper ends are mounted movably on the seat part on connecting articulations which are on the seat-part side, such that rocking and circular movements (and preferably also torsional movements) of the seat part can be performed with respect to its non-deflected home position.

In a preferred embodiment, at least three four-bar linkages are formed, with one four-bar linkage in each case being formed from in each case two directly adjacent legs, the seat part and the base surface, and the "coupler length" thereof being defined by the distance between the legs on the seat part, and the frame length thereof being defined by the distance between the legs on the base surface. The realisation of the linkage systems can accordingly be described equivalently in accordance with the principle of four-bar linkages. Thus the realisation of the three-dimensional linkage system can take place either by means of a plurality of movable chair legs, in particular pendulum chair legs ("legs" for short below) on the seat part. The legs in this embodiment are connected movably to the seat part at their (upper) connecting ends, not rigidly, but by means of a movable (preferably resilient) connecting articulation, so that three-dimensional rocking and circular movements and preferably also torsional movements of the leg connected thereto in each case relative to the seat part are possible. Preferably, three or four legs are connected to the seat part of the chair in each case with identical or similar connecting articulations. However, more than four legs may also be used.

In one alternative embodiment of the invention, the three-dimensional (yielding) linkage system may also be realised by means of flexible, elastically deformable legs which are fastened to rigid fastening elements on the seat part.

According to the invention, therefore, in its most general form an active-dynamic chair is provided which comprises the following: a seat part and a three-dimensional linkage system consisting of at least three legs with foot parts at their lower ends, wherein the legs in each case at their upper ends are mounted movably on the seat part on connecting articulations which are on the seat-part side, such that rocking and circular movements of the seat part can be performed with respect to its non-deflected home position.

In such a configuration, the positions of the connecting articulations span a common seat-part plane, by means of which the relative inclination of the seat part can be defined. In a preferred configuration of the invention, the legs are arranged symmetrically and the relative inclination of the seat part extends in a plane parallel to the base surface (on which the chair stands). In the non-deflected home position of the seat, the relative inclination of the seat surface is defined by the two polar angles ($\theta_1$, $\theta_2$), which are offset by the azimuth angle of 90°, of the normal to the seat-part plane which is as previously explained. Insofar as the seat-part plane is oriented parallel to the base surface, both angles are equal to 0°.

In one advantageous embodiment, the active-dynamic chair is configured such that each of the connecting articulations is formed as an articulation which permits rocking and circular movements of the leg which is connected thereto. Put another way, movements by a polar angle $\theta$ at different azimuth angles $\Phi$ with respect to the seat-part plane can be performed. It is particularly advantageous to form the articulations as resilient articulations, in order thus to obtain great mobility in various (three-dimensional) directions of deflection. It is even more preferable to provide an articulation with an elastically deformable articulation body which as a result of the elasticity provides an integrated restoring mechanism. In this way, the legs are coupled together mechanically via the common seat part. Two pairs of legs in each case can then be regarded as a four-bar linkage by the coupling to the seat surface, with the feet of the legs in such case bearing at defined points on the ground.

It is preferred if each of the connecting articulations is formed as an articulation of this type which permits a rocking and circular movement of the leg which is connected to the respective connecting articulation relative to the seat-part plane, and preferably such that the seat part can be deflected into a large number of different positions which can be described by a family of movement curves.

In a preferred embodiment of the invention, the inclination of the seat-part plane of the seat part changes upon movements of the seat part out of the home position into a deflected position such that that region of the seat which when performing movements is located further to the outside in each case is raised or lowered relative to the region located further to the inside.

Due to a desired pre-setting of the inclination of the seat surface of the seat part relative to the inclination of the seat-part plane, therefore, the change in inclination of the seat surface can be set by forming the leg length of the legs and their relative orientation accordingly.

A sequence of movement with a seat-part plane which is "raised up" towards the back upon deflection can be realised in that for example the legs are not oriented mutually parallel, but the foot points of two legs are further apart from each other compared with the upper connection points at the articulations. In this way, a four-bar linkage is formed from in each case two legs with the seat part and the base surface, the coupler (seat part) of which is shorter than the frame (base surface) thereof. It is preferred in this case, in the case of legs which are adjacent in each case, for the distance between their upper connecting ends in the seat-part plane to be less than the distance, close to the ground, between the respective leg ends between their foot parts. The foot parts may also be connected on a common footplate or a common ring element by means of connecting articulations, the degrees of freedom of movement of which are configured identically to the connecting articulations on the seat part. A form in which the inclination of the legs on the footplate and/or on the seat part is changeable is particularly preferable. This can be achieved by providing articulations which are adjustable in position. The foot parts may, in an alternative configuration, also stand directly on the base surface, where they are optionally additionally equipped with a slip-resistant end piece (for preventing shifting) or the like.

Alternatively, a sequence of movement in which the inclination of the seat-part plane does not change upon movement of the seat part, but rather the seat-part plane remains oriented parallel to the base surface and is merely lowered, can also be achieved by a parallel, preferably vertical, orientation of legs of equal length. In the case of legs of equal length, a symmetrical four-bar linkage is formed from in each case two legs with the seat part and the base surface. A four-bar linkage known from kinematics as a rule consists of a coupler, a frame and two connecting members. That means, transferred to the three-dimensional four-bar linkages in accordance with the present invention, that the seat part of the chair can be regarded as the "coupler" and the base surface as the "frame", while the legs are to be regarded as connecting members.

In a preferred configuration of the invention, the linkage system is further equipped with a sprung restoring mechanism, so that the deflected seat part is returned automatically into its home position.

Advantageously, the restoring mechanism is integrated in the connecting articulations. It is therefore particularly advantageous to form the articulations as resilient (elastically deformable) articulations which upon deflection generate a restoring force if the chair leg is guided out of its home position into a deflected position. For example, the articulations may be formed as resilient rubber articulations which are elastically deformed upon movement of the legs and thus generate a restoring force. Alternatively, the "yielding" linkage system can also be realised by means of resilient legs.

There are further possible ways of advantageously configuring and developing the teaching of the present invention. For this, reference is made on one hand to the claims dependent upon the independent claims, and to the explanations of preferred embodiments of the invention set out below. Generally preferred configurations and developments will also be explained in conjunction with the explanation of the preferred embodiments of the invention with reference to the drawings. In the drawings:

FIG. 3 shows four diagrammatic figures for the use of a chair with three legs similarly to FIG. 1;

Figure 4A:
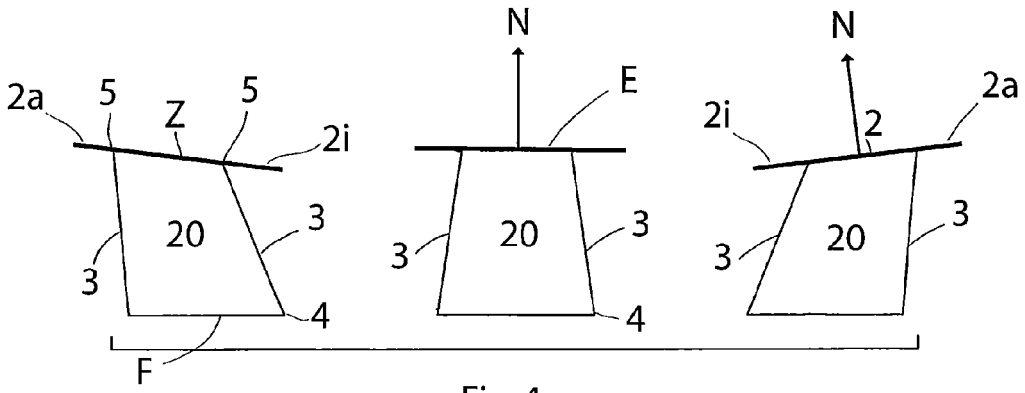
Figure 4B:
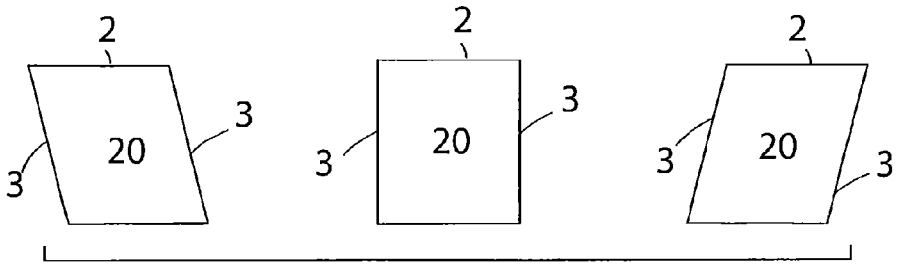
Figure 4C:
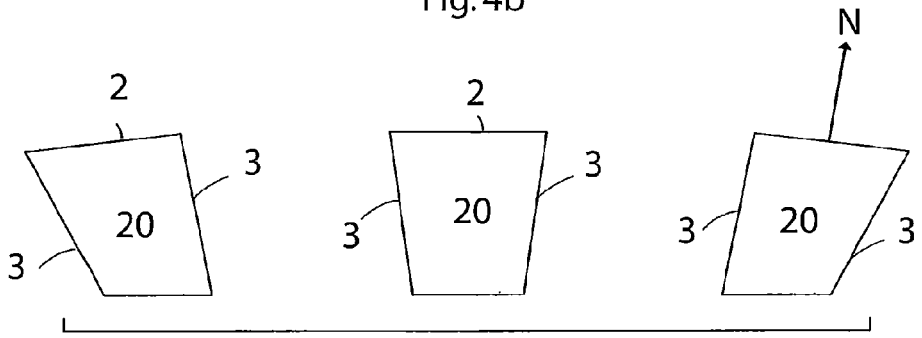
Figure 4D:
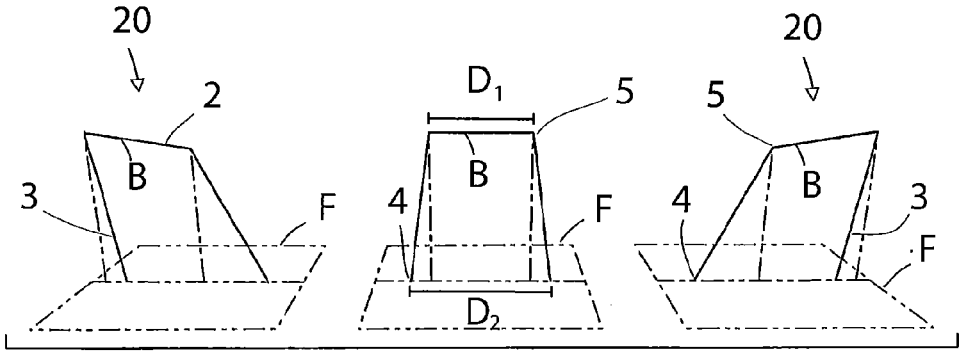
Figure 4E:
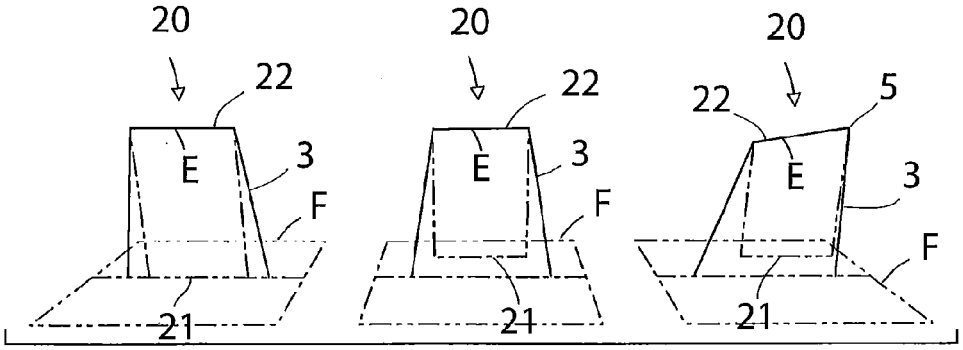
Figure 4F:
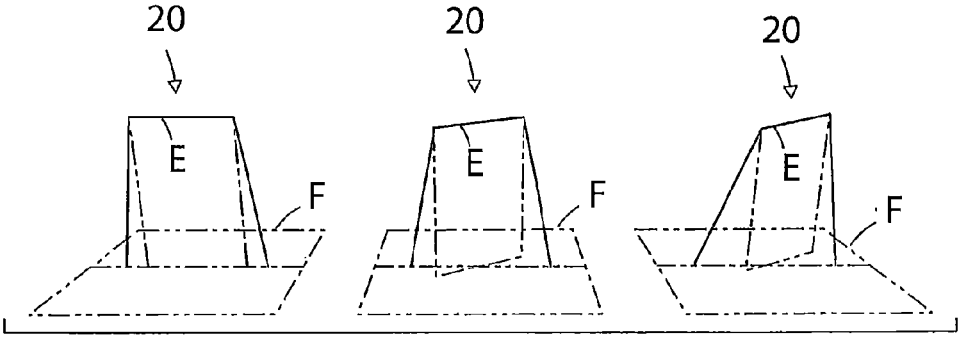
Figure 5:
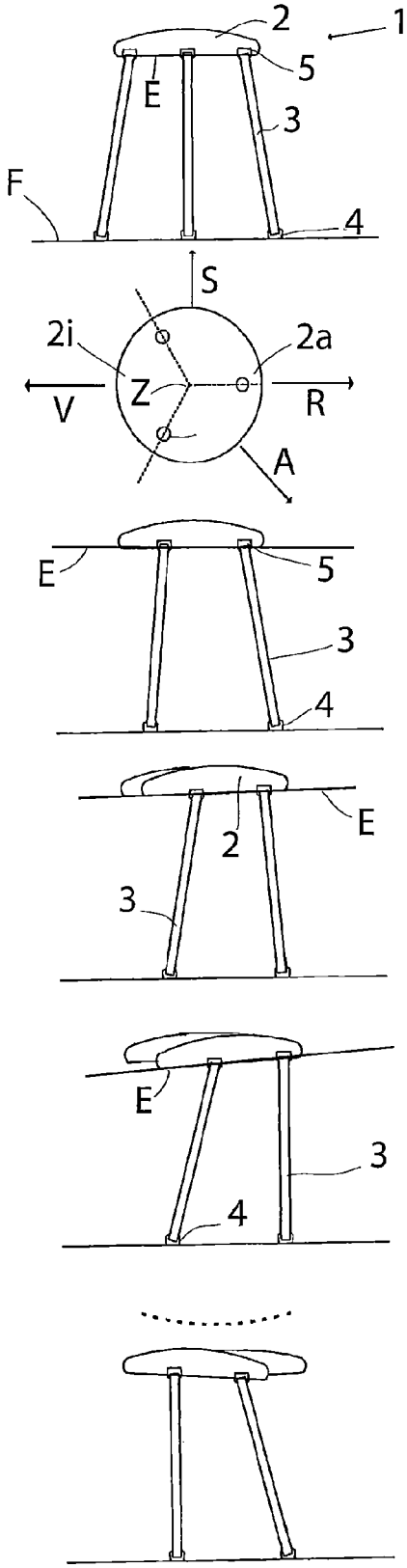
Figure 5A:
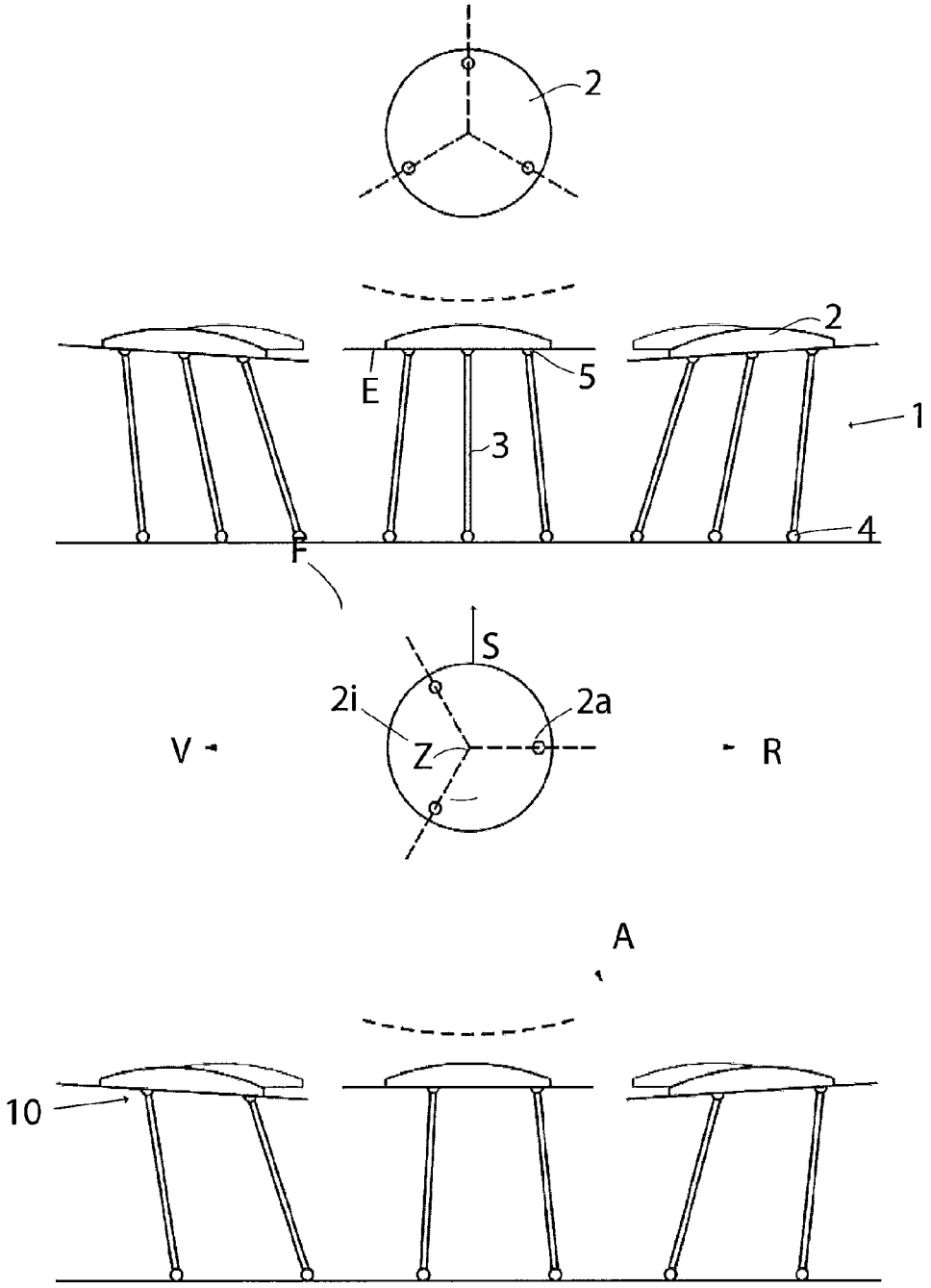
Figure 6:
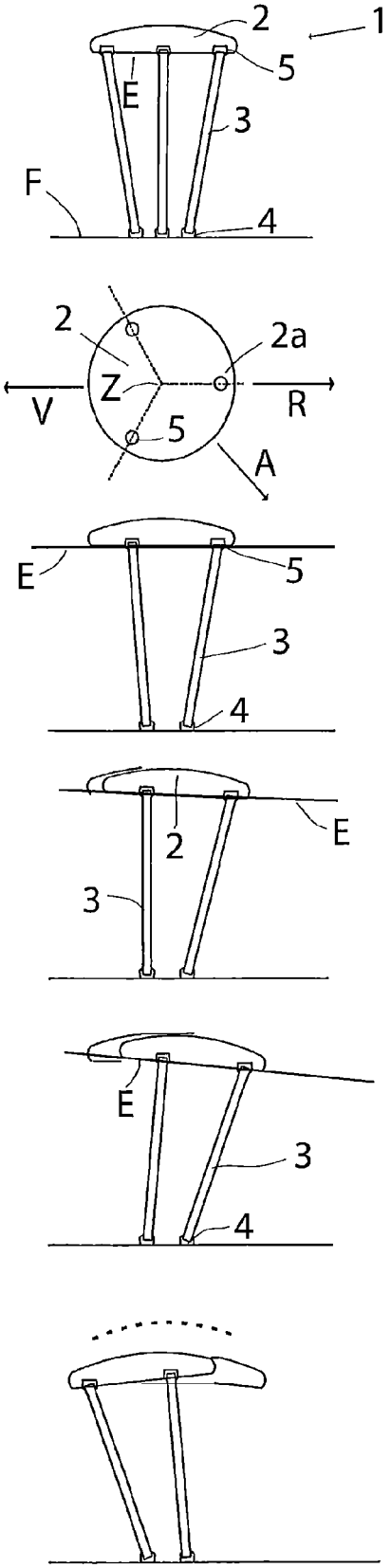
Figure 7:
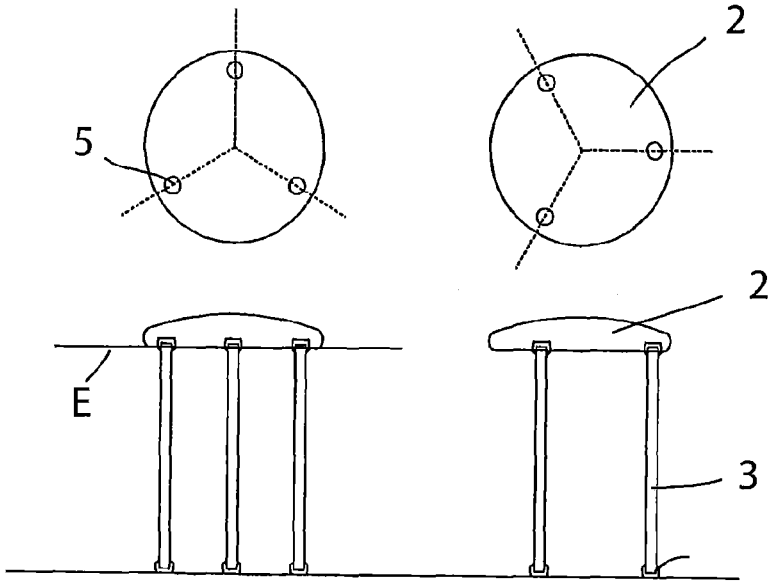
Figure 7:
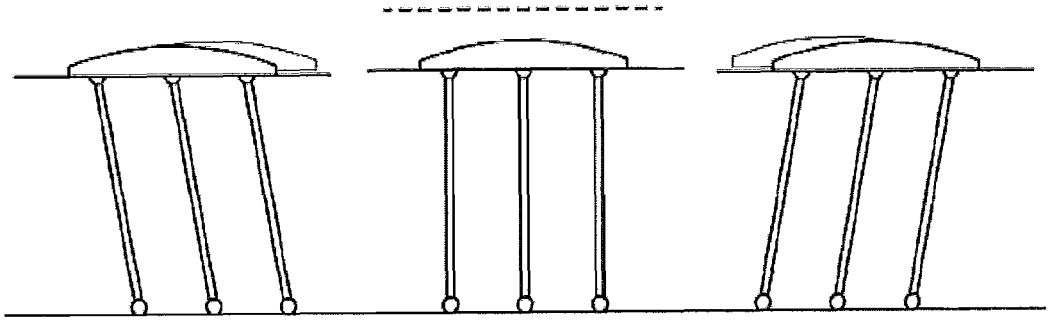
Figure 8A:
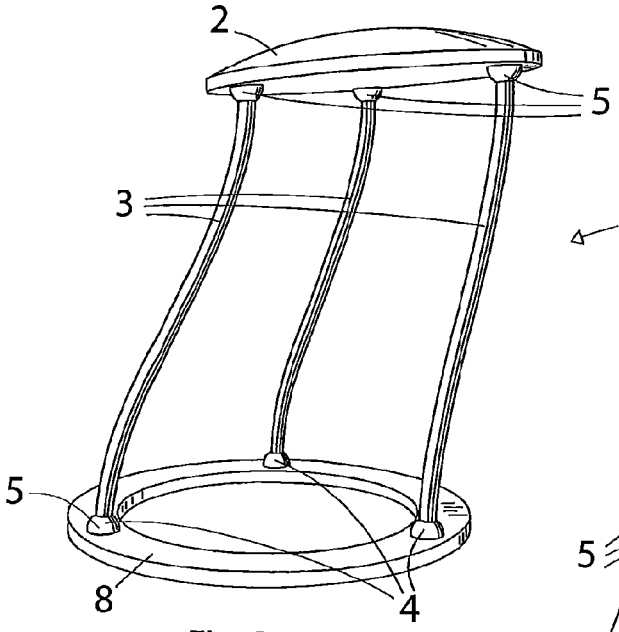
Figure 8B:
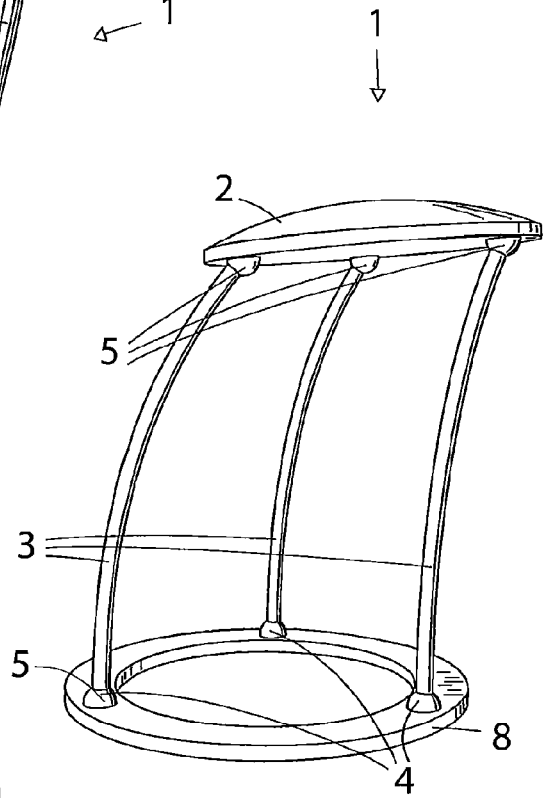
Figure 8C:
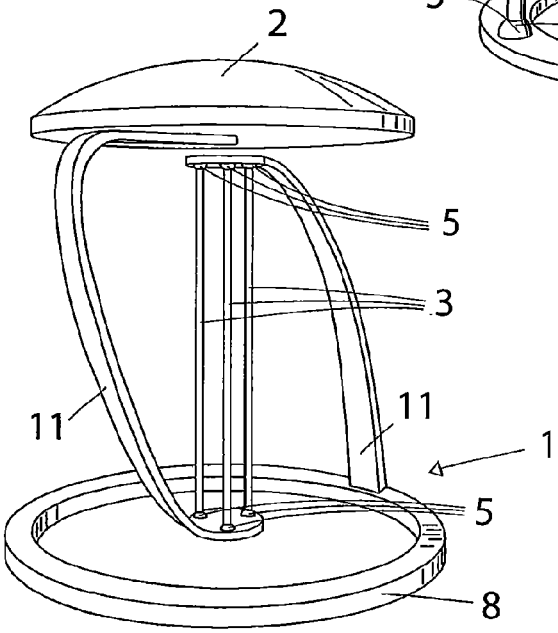
Figure 9A:
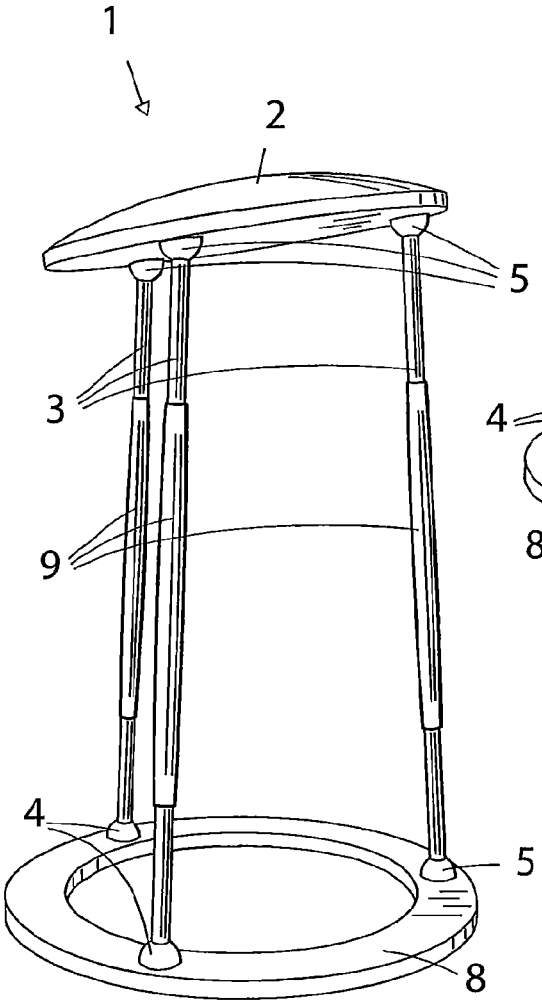
Figure 9B:
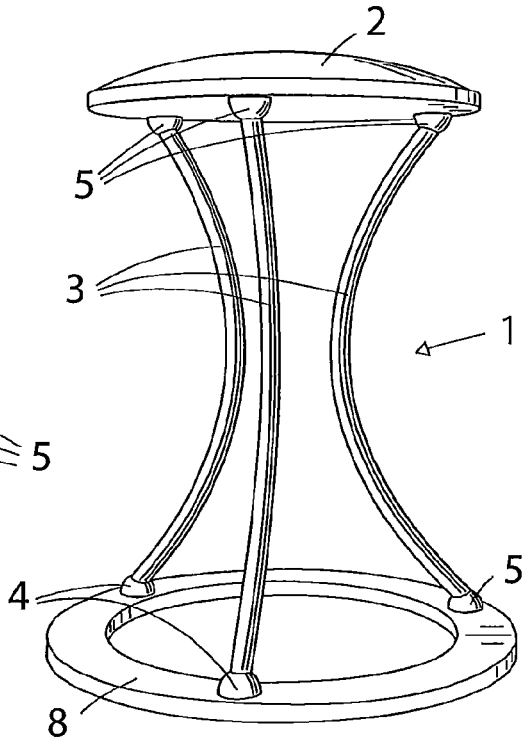
Figure 10:
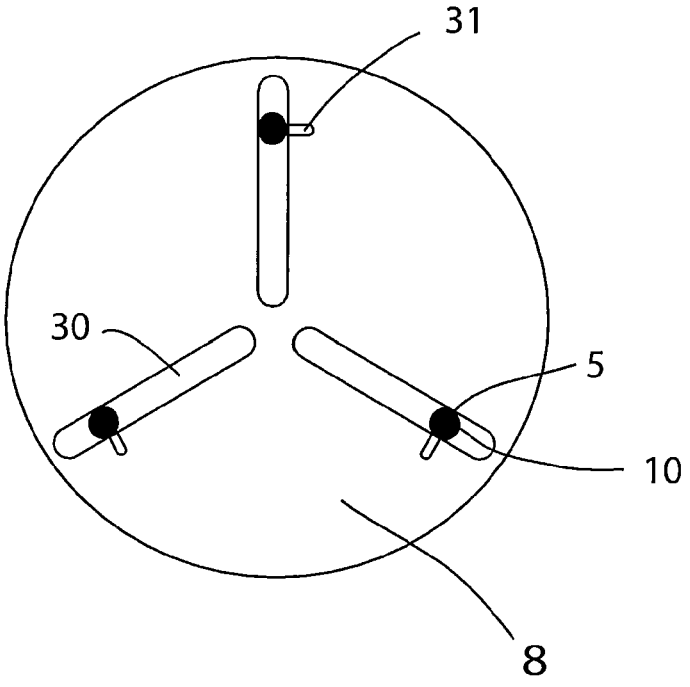
Figure 10:
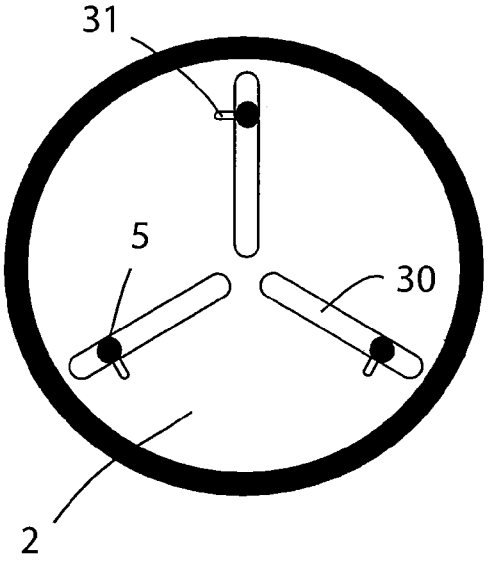
Figure 11:
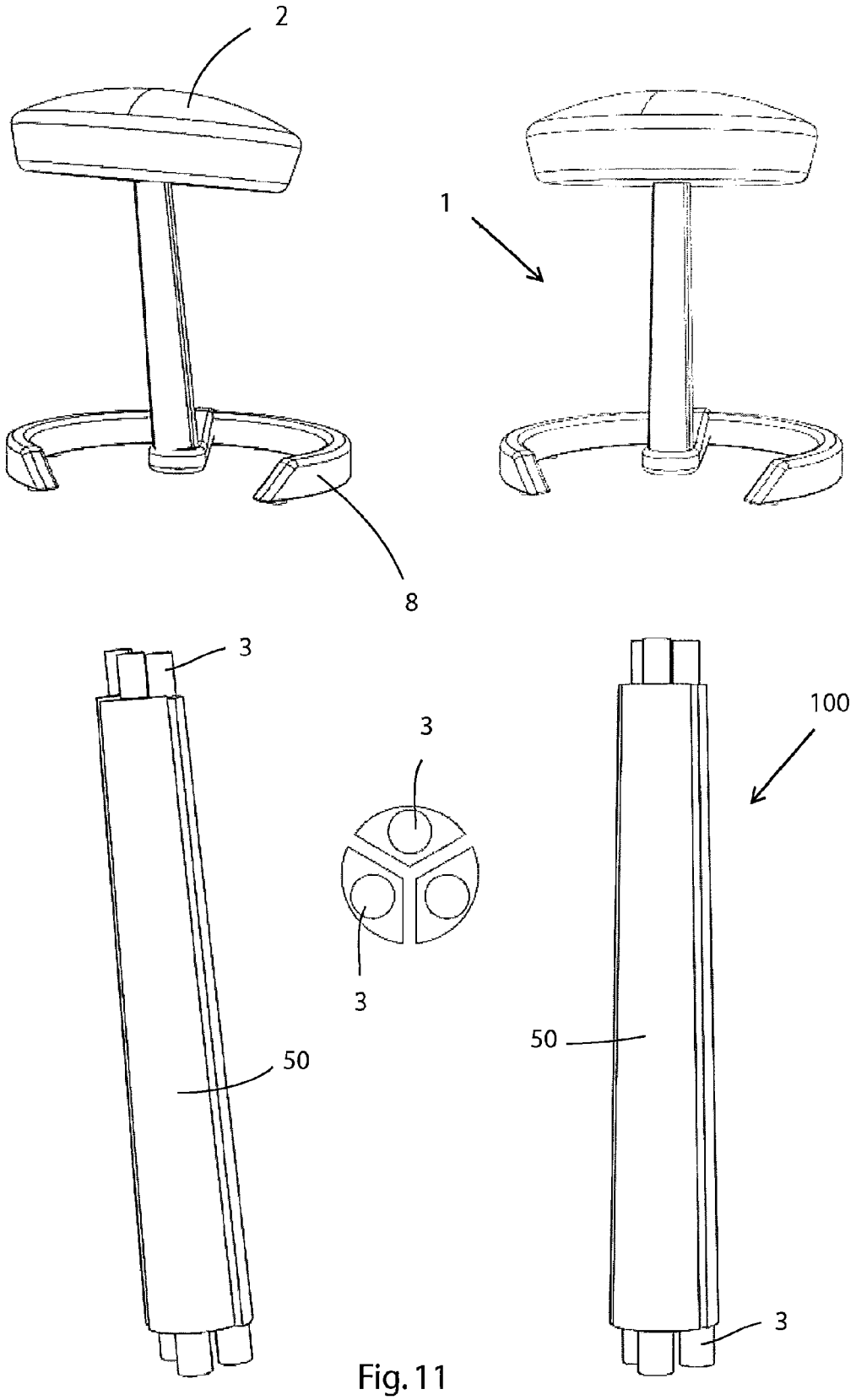
Figure 12:
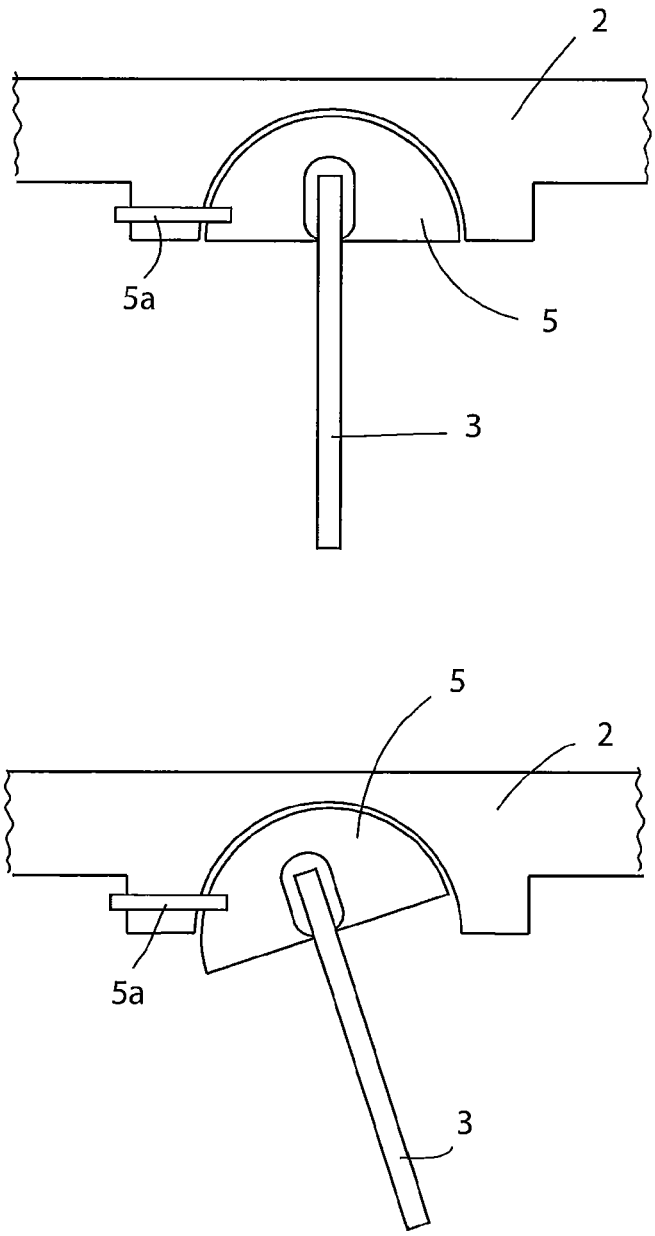

FIG. 4*a*, 4*b* show views of a simplified model of two chair legs of a chair according to the invention in different positions;

FIG. 4*c* shows views of a simplified model of two chair legs of a chair in different positions in which the seat surface is inclined outwards;

FIG. 4*d*-4*f* show views of a simplified model of two chair legs of a chair according to the invention in different positions;

FIG. 5 shows a plurality of views and positions of an embodiment of a chair according to the invention with three legs;

FIG. 5*a* shows a plurality of views and positions of an embodiment of a chair according to the invention with three legs similarly to FIG. 5;

FIG. 6 shows a plurality of views and positions of an alternative embodiment of a chair according to the invention with three legs;

FIG. 7 shows a plurality of views and positions of a further embodiment of a chair according to the invention with three legs;

FIG. 8*a*-8*c* show a plurality of alternative embodiments of a chair according to the invention;

FIG. 9*a*-9*b* show two further alternative embodiments of a chair according to the invention;

FIG. 10 shows a view of a footplate and a seat part with adjustable articulations in a top view and bottom view respectively;

FIG. 11 is a further example of a chair according to the invention with three legs in a central column, and FIG. 12 shows a chair leg, the inclination of which can be set by means of an adjustable articulation.

Figure 1:
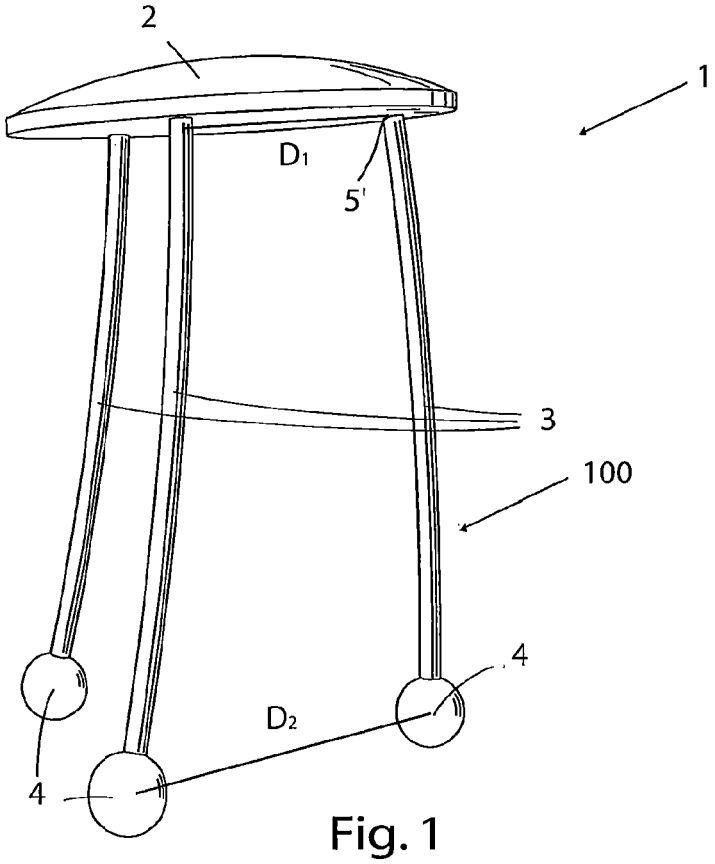
FIG. 1 is a first example of an active-dynamic chair according to the invention.
Figure 2:
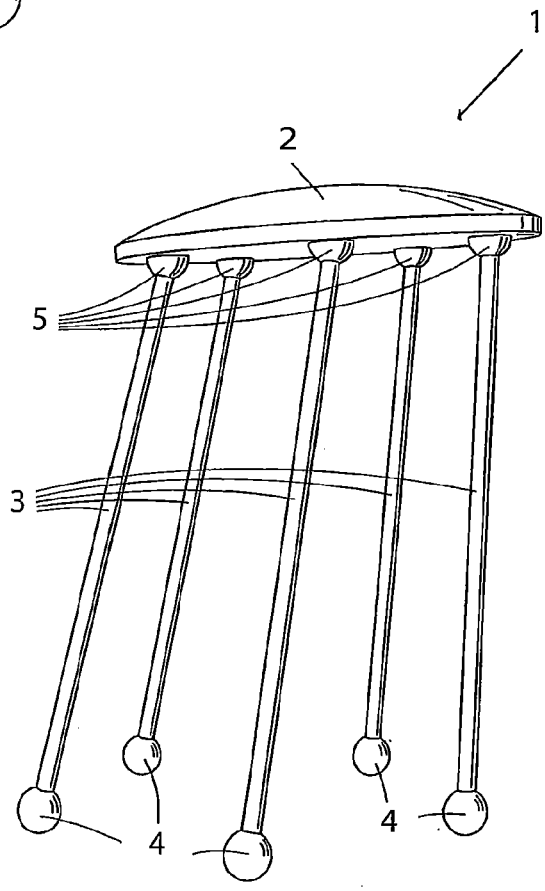
FIG. 2 is a second example of an active-dynamic chair according to the invention.

FIGS. 1 and 2 show two examples of an active-dynamic chair 1 according to the invention with a three-dimensional linkage system 100. The chair 1 in FIG. 1 is a stool here, and comprises a seat part 2 and three resilient legs 3 with foot parts 4, which are connected in each case to the seat part 2 by means of a rigid fastening element 5' such that the seat part 2 can be moved to and fro from its non-deflected home position into a deflected position, as is illustrated diagrammatically in the views of FIG. 3. The upper distance $D_1$ between two directly adjacent legs 3 in the seat-part plane E spanned by the fastening elements 5' in such case is less than the distance $D_2$ (close to the ground) between the respective foot parts 4. In FIG. 2, four resilient connecting articulations 5 have been connected to rigid legs 3.

A person 40 may, inter alia, perform the movements illustrated in FIG. 3 on the chair. In the upper right-hand and the lower left-hand view, the chair 1 is in its home position which the chair 1 adopts when it is not deflected. Upon swaying laterally to and fro and also upon rocking forwards and backwards, the inclination of the seat-part plane E changes, as is indicated in the lower right-hand and upper left-hand views of FIG. 3.

In FIG. 5, the seat part 2 in the second figure from the top is shown in a top view and the positions of the connecting articulations 5 are indicated merely in order to represent the positions. The seat part 2 may perform rocking and circular movements and thus also be deflected at various azimuth angles Φ. Exemplified deflections are represented with the arrows in the arrow directions A, V, R, S away from the centre Z outwards in each case. The central region between the articulations 5 on the seat part 2 is defined as the centre Z. In this case, that region of the seat part 2 which is located towards the outside upon movements in a direction of an arrow (here in the direction of the arrow R) in each case offset from the centre Z is referred to as outer region 2*a*, whereas that region of the seat part 2 which lies opposite with respect to the centre Z is referred to as inner region 2*i* in each case.

Upon a movement towards the rear (backwards) in the direction of the arrow R, as also shown in the lower right-hand view of FIG. 3, the seat-part plane E in the region 2*a* located further to the outside is raised, while the inner region 2*i* is lowered, as a result of which the seat-part plane tilts towards the centre Z, as is illustrated by the inclination of the normal vector N of the seat-part plane E in FIG. 4*a*. The arrow represents the normal vector N of the plane E.

In the home position of the chair (the middle figure in each case in FIG. 4*a*-4*c*), the seat-part plane E is oriented parallel to the base surface F and the normal vector N runs perpendicularly upwards. The FIGS. 4*a*-4*f* show different movement positions of chairs in a simplified model which reflects the model previously described of four-bar linkages from the linkage system. For reasons of better presentation, in each case only two chair legs 3 are viewed in a side view, which legs are connected movably to the seat part 2 at their upper ends via articulations 5, whereas the lower ends of the legs 3 are located on the base surface F at a different distance $D_2$. The distance $D_1$ between the legs 3 between the articulations 5 in the section region of the plane E is different in the FIGS. 4*a*-4*f*, so the principle according to the invention can be illustrated simply thereby.

FIG. 4*a* shows a model of a four-bar linkage 20 of a chair 1 according to the invention. The distance $D_2$ (defined as in FIG. 1 and FIG. 4*d*) between the foot parts 4 of two adjacent legs 3 on the base surface F is greater than the distance $D_1$ (defined as in FIG. 1 and FIG. 4*d*) between the legs 3 between the articulations 5 in the section region of the plane E.

If the chair 1 is deflected out of the home position into the supine position shown in the right-hand figure of FIG. 4*a* (as in the lower right-hand view of FIG. 3), the seat-part plane E inclines to the left towards the centre and that region 2*a* of the seat part 2 located further to the outside in the direction of movement R is raised, whereas the region 2*i* located further to the inside is lowered in height relative to the base surface F. This results from the leg ends at the articulations 5 being located along circular paths in a clockwise direction in sections on the circular path which differ in each case. The right-hand (outer) leg 3 moves with its upper articulation 5 in an "upwards movement" in a region between the 9-o'clock position towards the 12-o'clock position. The left-hand leg 3 moves with its articulation 5 along a circular "downwards movement" in a segment of a circle between the 12-o'clock position and the 3-o'clock position. This movement curve in this example is caused by the greater distance $D_2$ between the legs 3 between the foot parts 4 compared with the distance $D_1$ between the legs 3 between the articulations 5. The legs 3 in such case may also be mounted movably at articulations 5 on a footplate 8.

Alternatively, also different leg lengths can be used, since the leg ends with the articulations 5 are moved along different circular paths and the inclination of the seat part likewise changes as a result.

Upon a movement of the seat part 2 in the opposite direction V forwards (upper left-hand figure of FIG. 4*a*), the sequence of movement is exactly the opposite.

FIG. 4*b* shows a model of a four-bar linkage 20 of a chair 1 in which the inclination of the seat part 2 remains constant. This results from the vertical symmetrical position of the legs and the identical upper and lower distance between the legs 3. This achieves displacement of the seat part 2 upon which the seat-part plane E, upon a movement into a position as illustrated on the left and on the right in FIG. 4*b*, moves downwards. In this way, it is possible to prevent a change in the seat inclination occurring in the event of movements of the seat part 2. The rocking movement between the left-hand and right-hand view shown in the figures of FIG. 4*c* corresponds to the rocking movement of a pendulum chair in which the distance $D_2$ between the chair legs 3 at the ground is less than the distance $D_1$ at the top in the region at the connecting articulations 5. This brings about tilting of the seat outwards (as indicated by the normal vector N).

FIGS. 4*d* to 4*f* depict further forms of movement of chair models similarly to the embodiments of FIGS. 4*a* to 4*c*. Identical reference numerals here indicate identical features. The four-bar linkages shown here are moved with their coupler 22 (which corresponds to the seat part 2). The vertical projection of the coupler 22 onto the base surface F is represented by the projection line 21.

It can be seen that, in the positions of the legs 3 which are shown with a greater lower distance in the foot region at the foot parts 4, the seat inclination (as described in greater detail above) is inclined towards the centre. In this case, the seat-part plane E is raised in the outer region 2*a*, while the inner region 2*i* is lowered, as a result of which the seat part 2 tilts towards the centre.

FIG. 5 shows a plurality of positions in the case of the movement of a chair 1 according to the invention with a seat part 2. FIG. 5*a* diagrammatically indicates a sequence of movement which is comparable to the embodiment of FIG. 5. In the upper figure of FIG. 5, the chair 1 is shown in its home position and stands with the three legs 3 with its foot parts 4 on the base surface F. The legs 3 are in each case further spaced apart in pairs in the region of the foot parts 4 than in the seat-part plane E in which the connecting articulations 5 are arranged. In this embodiment, the connecting articulations 5 form receptacles for the ends of the legs 3. The legs 3 extend in each case inclined relative to the vertical from the ground to the connecting articulation 5 towards the centre Z. In the further figures of FIGS. 5 and 5*a*, a movement of the seat part 2 in the direction R backwards or V forwards is illustrated, whereas however only the front two legs 3 are illustrated in the side view, while the rear left-hand leg 3 is hidden. The seat-part plane E with its movement in the direction R is raised with its seat-part region 2*a* which is located to the outside. In the lower view, the change in the inclination of the seat-part plane E upon movements in the forwards direction V and backwards direction R is indicated by a broken line. This curve of the change in inclination of the seat-part plane exhibits a concave course in this example.

However, the inclination of the seat-part plane E of the chair 1 of FIGS. 5 and 5*a* also follows upon lateral movements for example in the direction S or other directions A in accordance with the movement pattern described above.

FIG. 6 shows a plurality of positions of a chair 1 in which there is a different orientation of the articulations 5 and the legs 3 in the home position and the legs 3, in particular in the region of the foot parts 4, are at a lesser distance apart than in the region of the articulations 5. This results in a movement pattern, as indicated in the lower figures of FIG. 6, in which the seat-part plane E tilts away outwards from the centre Z. In the lower view, the change in the inclination of the seat-part plane E upon movements in the forwards direction V and backwards direction R is indicated by a broken line. This curve exhibits a convex course.

FIG. 7 shows a plurality of positions of a chair 1 in which there is a parallel orientation of the legs 3, and the legs 3 in the region of the foot parts 4 are therefore at an identical distance apart to the distance in the region of the resilient connecting articulations 5. This results in a movement pattern as is indicated in the lower figures of FIG. 7, with the seat-part plane E upon movements remaining oriented parallel to the ground, but being lowered in its vertical position. The upper views show two different orientations of the chair 1. The inclination of the seat-part plane E in the case of movements in the forwards direction V and backwards direction R is reproduced with the aid of the broken line. This curve exhibits a rectilinear course, which means that the relative inclination does not change upon the movements shown.

In the figures of FIGS. 8*a* to 9*b*, exemplified alternative configurations of a chair 1 according to the invention with a seat part 2 and an annular footrest 8 are shown. The legs 3 in FIGS. 8*a*, 8*b* and also 9*a* and 9*b* at their upper ends are articulated to the seat part 2 with the connecting articulations 5 (similarly to the embodiments previously described). In FIGS. 8*a*, 8*b*, 9*a* and 9*b*, the foot parts 4 are likewise formed as connecting articulations 5 or connected in articulated manner with articulations 5. The configuration of the connecting articulations 5 close to the ground is such that the movement of the legs 3 is not hindered. In the present case, resilient articulations 5 are illustrated.

In FIGS. 8*a*, 8*b* and 9*b*, further the legs 3 are formed resiliently, whereas the legs 3 in FIG. 9*a* are constructed rigidly, but can be telescoped and hence adjusted in terms of length by means of telescoping devices 9. In this way, the inclination of the seat-part plane E can be pre-set or changed.

FIG. 8*c* shows a special embodiment in which a sprung oscillating arm 11 bears the seat part 2, and on the lower end (close to the ground) thereof three vertically oriented legs 3 extend upwards in the direction of the seat part 2 and are connected there to a further spring arm 11 with a footrest 8. Each spring arm 11 forms a holding plate with connecting articulations 5, on which articulations the legs 3 are mounted in articulated manner.

In a further preferred embodiment, the connecting articulations 5 are provided on the seat part 2 and/or the footplate 8 so as to be settable, preferably radially displaceable or changeable in position.

FIG. 10 shows a top view of a footplate 8 in which the footplate 8 is provided with adjustment elements 30. In the present example, the adjustment elements 30 are formed as rails 30 along which the articulations 5 can be moved to and fro and can be fixed in their positions on the rail 30 by means of a fastening device 31, such as a locking lever with an eccentric. In this way, the inclination of the legs 3 and hence the distance, close to the ground, between the legs 3 can be varied. It is particularly preferable in such case also to be able to vary the inclination of the connecting articulations 5. This is shown by way of example in the figures of FIG. 12, where an articulation 5 which is "inherently" resilient is mounted in a socket on the seat part 2 so as to be adjustable in its inclination and can be fixed in its set position by means of a locking means 5*a* (for example a locking screw or an eccentric). In this way, the inclination of the legs is adjustable for the seat user.

FIG. 10 further illustrates a bottom view of a seat part 2 with corresponding rails 30 for displacing the articulations 5. Such a seat part 2 can be combined with a foot part 8 as previously described, so that many different possible ways of setting the articulations 5 and hence the orientation and relative distances between the legs 3 are yielded.

In this way, the chair user can set the desired seat inclination and change in inclination individually.

FIG. 11 shows a further example of a chair 1 according to the invention with a three-dimensional linkage system 100 consisting of three legs 3 which form a three-part column 50. The method of operation and connection to the foot part 8 and the seat part 2 is implemented analogously to the embodiments described above by means of connecting articulations 5.

Combinations of the embodiments previously mentioned and of individual features are also covered and are intended to be able to be claimed individually, as are alternative embodiments which are not explicitly mentioned. Thus for example instead of the rails 30 individual receiving positions can be provided on the foot part 8 and/or on the seat part 2 in order to be able to effect defined settings. Advantageously, these are lockable, adjustable in inclination and individually settable. Further, provision may be made for the legs 3 in their inclination relative to each other to be settable and lockable in inclination in a plane radially to the centre by an adjustment mechanism. It is particularly advantageous if the adjustment mechanism has a stop, preferably in a direction towards the front and towards the rear, or towards the inside and towards the outside.

The invention claimed is:

1. An active-dynamic chair, comprising the following:

a seat part, a three-dimensional linkage system including at least three legs with respective foot parts at lower ends of the at least three legs, each foot part pivotally coupled to a footplate, wherein each of the at least three legs at an upper end are mounted movably on the seat part by at least three connecting articulations separate from the at least three legs, each of the at least three connecting articulations being attached to a seat-part side of a respective one of the at least three legs such that rocking and circular movements of the seat part can be performed with respect to a non-deflected home position of the seat part;

the three-dimensional linkage system is formed by at least three four-bar linkages, each of the at least three four-bar linkages including two directly adjacent legs of the at least three legs, a portion of the footplate, and a portion of and the seat part;

the inclination of the seat part changes upon movements of the seat part out of the non-deflected home position into a deflected position, a desired change in inclination of a seat-part plane of the seat part being able to be set by changing a length of the legs and by changing the orientation and inclination of the at least three legs relative to one another; wherein the connecting articulations are formed as elastically deformable articulation bodies which permit three-dimensional rocking, circular, and torsional movements for each of the legs relative to the seat part.

2. The active-dynamic chair according to claim 1, wherein a restoring mechanism is provided to return a deflected seat part automatically into its non-deflected home position.

3. The active-dynamic chair according to claim 2, wherein the restoring mechanism is integrated in the connecting articulations by using elastically deformable articulations which upon deflection of the at least three legs are elastically deformed to generate a restoring force.

4. The active-dynamic chair according to claim 1, wherein each of the foot parts is are mounted movably on the footplate by at least three additional connecting articulations.

5. The active-dynamic chair according to claim 1, wherein the connecting articulations which are on the seat-part side are arranged in a common seat-part plane on an underside of the seat part which defines an inclination of the seat part.

6. The active-dynamic chair according to claim 1, wherein in the non-deflected home position of the seat part, the foot parts are arranged further to an outside or further to an inside or vertically beneath the connecting articulations.

7. The active-dynamic chair according to claim 1, wherein a distance between at least two of the connecting articulations on at least one of the seat part or the foot parts is settable by adjustment means, continuously displaceable along the adjustment means or the legs are each settable in an inclination.

8. An active-dynamic chair, comprising the following:

a seat part;

a three-dimensional linkage system including three, four or five legs with respective foot parts at lower ends of the legs, each foot part pivotally coupled to a footplate, wherein each of the legs at an upper end are mounted movably on the seat part by three, four or five connecting articulations separate from the legs, each of the connecting articulations being attached to a seat-part side of the respective leg, such that rocking and circular movements of the seat part can be performed with respect to a non-deflected home position of the seat part, and each of the connecting articulations being attached to a respective rail extending lengthwise radially on an underside of the seat part relative to a center of the seat part such that a distance between the connecting articulations can be preset;

the three-dimensional linkage system is formed by at least three four-bar linkages, each of the at least three four-bar linkages including two directly adjacent legs of at least three legs of the legs, a portion of the footplate, and a portion of the seat part;

an inclination of the seat part changes upon movements of the seat part out of the non-deflected home position into a deflected position, the chair is configured to undergo a desired change in an inclination of a seat-part plane of the seat part in response to at least one of rocking, translational, or rotational forces from movement of a pelvis of an occupant sitting on the seat part, the chair configured for pre-setting the inclination of the seat part by changing a length of the legs and by changing the orientation and inclination of the at least three legs relative to one another.

9. The active-dynamic chair according to claim 8, wherein the three, four or five legs are rigid legs.

10. The active-dynamic chair according to claim 1, wherein the at least three legs are rigid legs.

* * * * *